United States Patent [19]

Alduk et al.

[11] 4,240,237

[45] Dec. 23, 1980

[54] CONTAINER LIFTING, TRANSPORTING AND RELEASING APPARATUS

[76] Inventors: Frank P. Alduk, McGary Rd., New Wilmington, Pa. 16142; Dennis F. Alduk, Sunset Valley Rd., New Castle, Pa. 16105

[21] Appl. No.: 955,893

[22] Filed: Oct. 30, 1978

[51] Int. Cl.[3] ..... B65B 21/18

[52] U.S. Cl. ..... 53/247; 294/93; 414/416; 414/751

[58] Field of Search ..... 53/247; 294/93, 34, 294/103 R; 414/416, 751

[56] References Cited

U.S. PATENT DOCUMENTS

| | | | |
|---|---|---|---|
| 2,281,730 | 5/1942 | Thompson . | |
| 2,592,017 | 4/1952 | Engstrom . | |
| 2,656,060 | 10/1953 | Fischer et al. | 414/416 |
| 2,681,247 | 6/1954 | George . | |
| 2,953,407 | 9/1960 | Cella | 414/416 X |
| 3,144,148 | 8/1964 | Merkner et al. . | |
| 3,209,923 | 10/1965 | Bargel et al. | 53/247 X |
| 3,302,968 | 2/1967 | Bleiman et al. | 294/103 X |
| 3,314,714 | 4/1967 | Brubaker . | |
| 3,553,932 | 1/1971 | Rowekamp . | |
| 3,762,754 | 10/1973 | Goyarts | 294/81 SF X |

*Primary Examiner*—Travis S. McGehee

*Attorney, Agent, or Firm*—Parmelee, Miller, Welsh & Kratz

[57] ABSTRACT

A case packer and/or case unloader apparatus especially but not exclusively designed for packing small bottles in an orderly pattern into a shipping carton, or conversely, removing a case load of such bottles from a carton has a horizontally reciprocable carriage from which is suspended a vertically movable lifting frame. This frame carries spaced pairs of bars movable lengthwise relative to each other. Each bar has a spaced series of depending container engaging fingers with the fingers on one bar having lateral projections thereon extending in a direction opposed to lateral projections on the fingers of the other bar. By sliding the two bars of the pair in opposite directions, the fingers will approach or recede from each other. With the fingers of each pair close together, the frame may be lowered to enter a pair of fingers into the neck of each bottle of a prearranged group. By then moving the bars in opposite directions, the projections on the fingers engage the interior of the bottles. So engaged, the frame is lifted, lifting the bottles in their prearranged pattern. With projections on the fingers arranged in confronting relation to each other, the fingers may grip the exterior of the bottle necks. The apparatus by which the bottles are arranged in a predetermined pattern is an adaptation of that used in conventional case packers for larger containers.

13 Claims, 12 Drawing Figures

CONTAINER LIFTING, TRANSPORTING AND RELEASING APPARATUS

This invention is for an apparatus for the lifting and transporting of containers, particularly glass bottles, jars and the like in operations, for example, like the transfer of the containers from a case packer and their deposit in a carton or shipping case, or conversely removing them from a carton, and depositing them elsewhere, perhaps on a conveyor on which they are carried to a filling or other processing apparatus.

Although adaptable for the lifting and transfer from one location to another of containers one at a time, this invention is especially useful for simultaneously lifting a number, as, for example, a carton lot of small containers, as above described, grouped in a predetermined pattern from a case packer of which it constitutes a part or an attachment and depositing them in the same arrangement in a carton, or removing them from a carton and depositing them elsewhere. The invention will be herein described in connection with a case packing operation without, however, restricting it to such purpose.

Alduk patents, U.S. Pat. No. 3,546,838 of Dec. 15, 1970, and U.S. Pat. No. 3,619,967, show case packers such as may be used where the containers are manufactured or where, after being filled, they are packed into a carton. In such operations the containers are delivered haphazardly onto the conveyor of a case packer where, as in U.S. Pat. No. 3,546,838, they are arranged in parallel rows lengthwise and crosswise and a prearranged number of containers so arranged is discharged in a group onto a receiving platform to be placed in a carton in which the snugly fit. In the second of said patents the containers, which here must be of circular contour, arrange themselves in a so-called "nested" pattern where the containers are in parallel rows crosswise of the conveyor and there are an equal number of containers in each row, but the containers of each such row fit into the partial cavities between the containers of the preceding row. In either case, when a case lot of containers so arranged has been accumulated on a receiving platform, the delivery of more containers to the receiving area is blocked until the case lot of containers on the receiving platform are put into a carton. In the former patent, the receiving table tilts and the containers slide into the open of a carton. In the second patent, an operator places an inverted carton over the containers on the receiving table and the platform then tilts in a manner to flip the now loaded carton over.

In still other case packers, the receiving platform is arranged with a bottom structure that momentarily opens to drop the load of containers into a carton below.

While all three types of case packers perform satisfactorily with larger containers, where a case lot is usually in the range of twelve to twenty-four units, they are not well adapted for case loading or unloading of small bottles or jar-like glass containers and vials where a case lot is generally several dozen and where, in many instances, space limitations render inexpedient the use of said former types of case packers. Various suction devices or pneumatically expanded lifting devices have been attempted, but they too have proved impractical for this purpose.

The present invention in one embodiment involves an overhead carriage from which a vertically movable frame is suspended. This frame carries a pair of oppositely movable rigid lifting fingers for each container. These fingers may be closed together when the frame is lowered and a pair of fingers enters each container. Then the fingers are spread apart and projections on the fingers, now extending under the interior should below the neck of the jar or bottle, hold the bottle while the frame is raised and the carriage moves to an unloading position. At the unloading position the frame is lowered over the open top of the packing case, carton, or other receiver, and the fingers then moved to their closed position to be withdrawn through the neck of the container as the frame is lifted and the carriage returned to its starting position. In some cases, the contour of the bottle or the neck opening is too small for insertion of lifting fingers into the bottle. In such cases each pair of fingers may be open as the frame is lowered and then operated to close against the exterior of the bottle to grasp and hold it while it is lifted and transported and to then release the grasp when the container is close to or on the surface where it is to be deposited.

As constructed for transferring as many as several dozen small containers from a case packer which arranges the containers on a receiving platform, as above described, or other prearranged pattern and placing them in a carton, the overhead carriage is reciprocated along a fixed track for a distance at least great enough to clear the receiving platform on which the containers are arranged to a station where it will be directly over a fixed support for a carton. Said carriage has suspended therefrom a platform movable vertically by means of a fluid pressure cylinder and piston unit on the carriage and this platform, in turn, has the actual lifting head spaced below it.

The lifting head comprises an open frame structure with several pairs of parallel bars or strips with the bars of each pair set edgewise in face-to-face sliding contact against the other. The ends of one bar of each pair are hooked to a common connecting rod extending transversely of the lengths of the bars and which are movably carried in the frame. The opposite ends of the other bars are similarly hooked to a similar connecting rod. Means on the said platform are arranged to simultaneously move the two connecting rods transversely of their lengths toward or away from each other and thereby slide the parallel strips of each pair one against the other in opposite directions.

The invention may be more fully understood by reference to the accompanying drawings, wherein.

Figure 5:
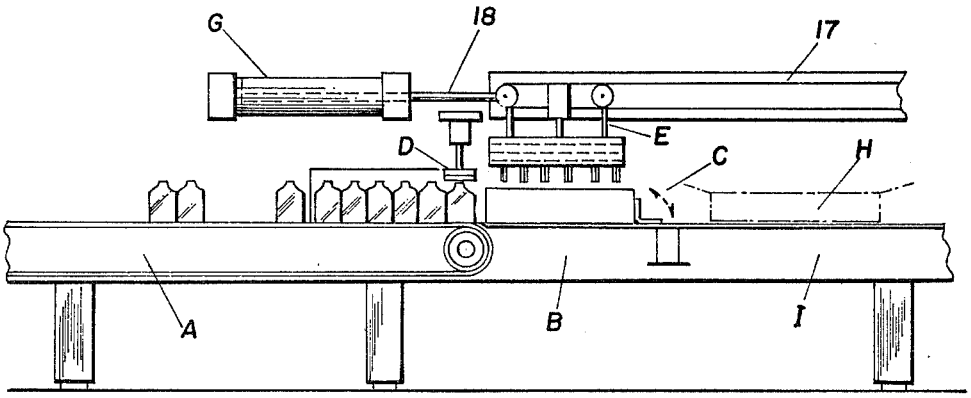
Figure 7:
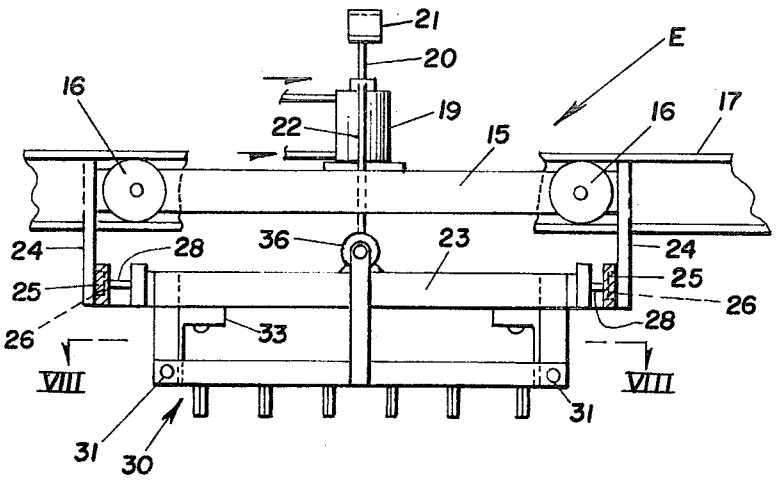
Figure 6:
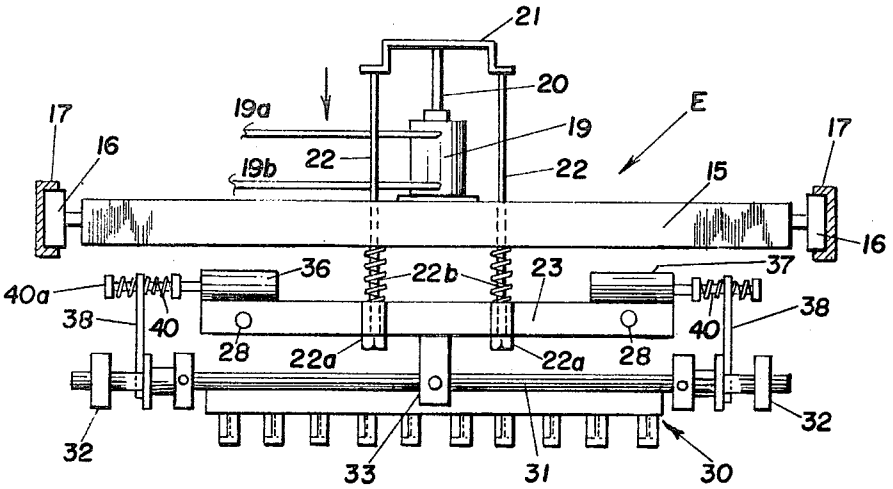
Figure 8:
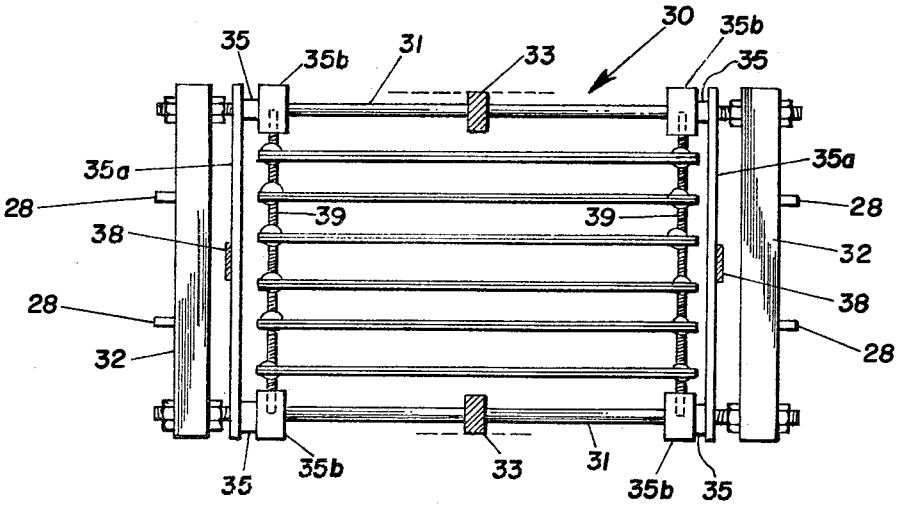
Figure 9:
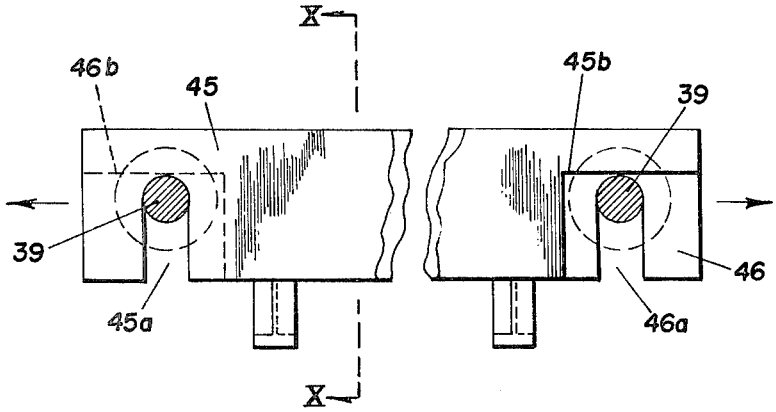
Figure 10:
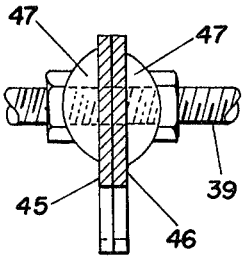
Figure 11:
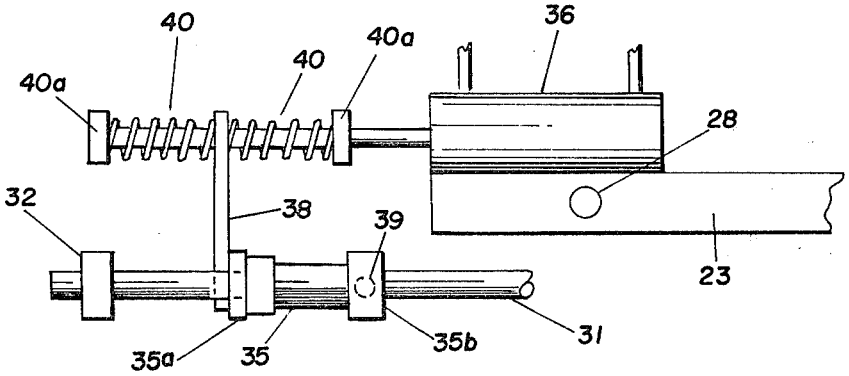
Figure 12:
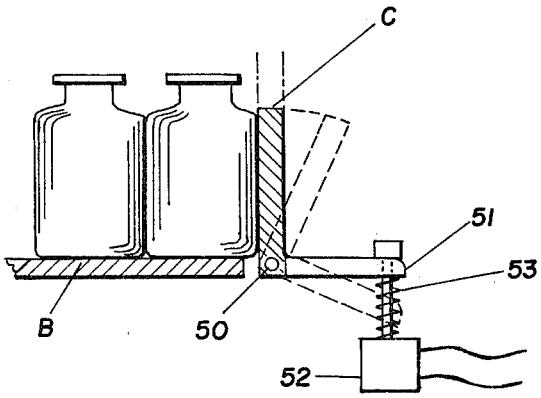

FIG. 5 is a schematic view illustrating the application of the invention to a case packer of the general type shown in U.S. Pat. No. 3,546,838 or U.S. Pat. No. 3,619,967;

FIG. 6 is a somewhat diagrammatic view of a container lifting and transporting assembly of the kind outlined in FIG. 5, the view being a side elevation;

FIG. 7 is an end elevation of FIG. 6, the supporting track being broken away for clarity of illustration;

FIG. 8 is a horizontal section in the plane of line VII—VII of FIG. 7 showing in plane the lifting head;

FIG. 9 is a side elevation of a single pair of bars, showing their reversal end for end, with each having one end hooked over one rod and slidable on the other, the rods being shown in section;

FIG. 10 is a transverse section in the plane of line X—X of FIG. 9;

FIG. 11 is a fragmentary side elevation showing the manner of transmitting motion transversely of its length to one of the bars shown in section in FIG. 9; and FIG. 12 is a somewhat schematic detail showing an arrangement for slightly moving the limit plate on the receiving table for relieving the pressure of the bottles against said plate and against each other before the actual upward movement of the lifting head begins.

Figure 1:
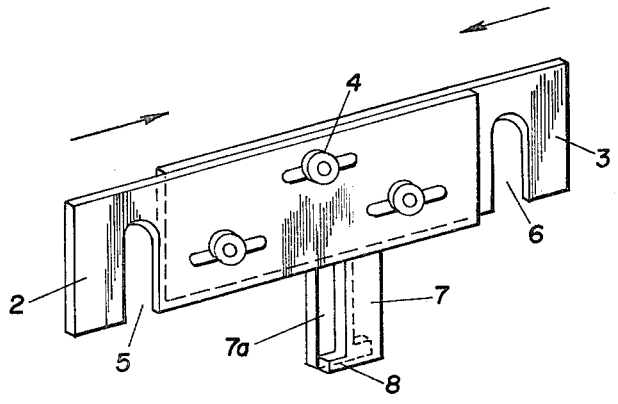
FIG. 1 is a perspective view of a simple embodiment of the invention designed for engaging a single container, the view showing the two bars of a pair in face-to-face relation with a hook at the end of each, but one has the hook at the left end and the other at the right, and there is a finger depending from the edge of each bar with the two fingers overlapping.
Figure 3:
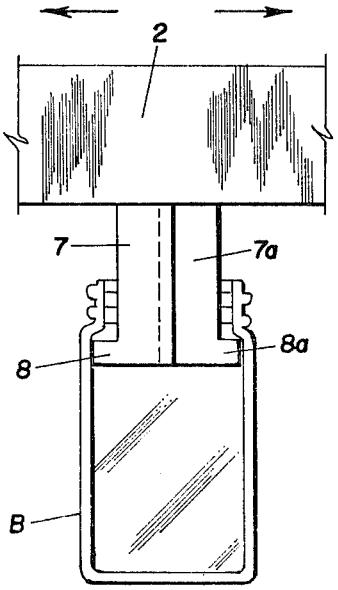
FIG. 3 is a fragmentary view of the apparatus of FIGS. 1 and 2, showing the fingers engaged with a typical container to illustrate the manner of engaging the container for lifting, transporting or lowering it.
Figure 2:
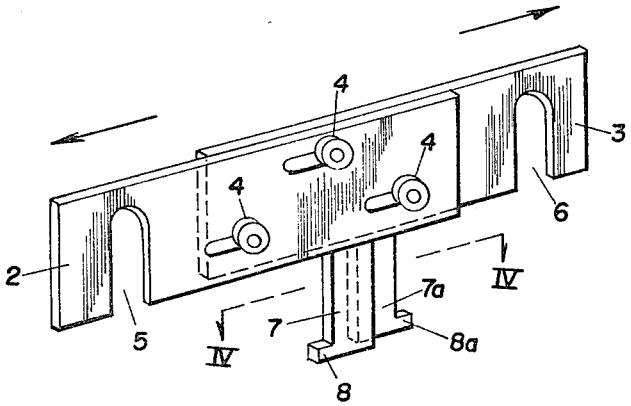
FIG. 2 is a similar view showing the fingers spread apart.

Referring first to FIGS. 1 to 3, the container lifting unit comprises two thin strips, which may be metal or plastic, designated 2 and 3. Nylon strips are quite satisfactory because they can slide, one against the other, without excessive friction. As here illustrated, headed pins 4 passing through slots in one strip 2, are secured in the other strip 3. This holds the strips in face-to-face contact and permits limited sliding movement of the stips relative to each other. One strip has a slotted terminal 5 at one end and the other strip has a similar terminal 6 at its opposite end.

On the lower edge of each strip there is a slender, preferably integral coplanar finger 7 on strip 2 and 7*a* on strip 3, the two fingers in FIG. 1 desirably being similar in shape and size but reversed with respect to each other. As shown in FIG. 1, these fingers pretty much or completely (see FIG. 9) overlap each other. Thus, as seen in FIG. 9, each pair of fingers appears as a single depending rectangle and the maximum width of the rectangle determines the minimum diameter of a bottle or other opening into which the pair of fingers may be inserted, but for practical purpose, this width should be smaller than the diameter in order that the fingers may be spread as hereinafter described to lift a bottle or the like after insertion. The combined thickness of the two fingers, as contrasted to the width, is always less than the diameter of the opening because the fingers, being coplanar with the strips, are of a combined thickness less than the width of the fingers in the direction of the strips. Finger 7 on strip 2 has a horizontally extending lug 8 turned toward its end 5, and finger 7*a* has a similar lug 8*a* turned in the opposite direction toward its terminal 6. When tension is applied to the respective terminals 5 and 6, the fingers 7 and 7*a* move in opposite directions, as shown in FIG. 3, and of course their integral lugs move away from each other.

In operation, the two fingers 7 and 7*a*, being in overlapping or closed position, can be entered through the neck of a small bottle or condiment or spice jar B as in FIG. 3, and then fingers 7 and 7*a* are spread, bringing their respective terminal lugs 8 and 8*a* under the internal shoulder below the neck of the bottle, and when the unit is lifted vertically, the bottle B will also be lifted and held until the terminals of the two strips are moved toward each other. While this may, of course, be done also by moving only one strip relative to the other both in engaging and disengaging the bottle, it is better, as will be later seen, that where there are several bottles, each pair of fingers be lowered through the center of the neck of each bottle.

Figure 4:
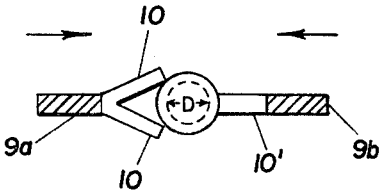
FIG. 4 is a transverse section in plane of line IV—IV of FIG. 2 showing an alternative arrangement of fingers such as may be used with handling of small bottles and vials, all of the views in FIGS. 1 to 4 being illustrative of important elements in the views which follow showing a more complete embodiment of the principal of the foregoing figures in one type of machine.

Sometimes some bottles have necks of small internal diameter, too small for the fingers to be entered or having no internal shoulders. In such case, the fingers of the strips may be formed with confronting lugs arranged to grip the outside of the bottle necks, as shown, for example, in FIG. 4. In this figure the bars or strips are the same as 2 and 3 in the preceding views, but the two fingers of a pair 9 and 9*a* are normally spread instead of overlapping and the terminal lugs confront each other. Finger 9*a*, for example, has two lugs 10 which diverge from its base, and 9*b* has a single lug 10' that is positioned in a plane midway between the lugs 10 so as to engage the circular neck of a bottle at three substantially equidistant points about the neck when the bars are moved relatively in opposite directions in such manner that the space between the lugs closes. In this case, the spread lugs of one finger prevent complete overlapping of the fingers and lugs, as in FIG. 9, but do not prevent the fingers themselves from overlapping. In each case the offsetting of the fingers which operate to lift the same bottle are in separate but adjacent planes. In one case the fingers in overlapping relation are enabled to enter the neck of a bottle, but in FIG. 4 two fingers which could at some time be side by side will not be fingers of the same pair. In this case the offsetting resulting from the fingers of a pair being in different planes, instead of across the full diameter of the bottle necks, enables the lugs to enter the space between the outside of the necks of two closely spaced bottles.

While in some cases a single pair of strips with one leg on each pair might be used, generally the invention has application to the handling of a group as, for example, several dozen small containers as a unit. As an example, there is here disclosed an apparatus such as might be employed by a producer of small glass bottles or spice of condiment jars to be shipped in carton or case lots of perhaps five dozen, or sixty units per case.

The units are delivered to the case packer haphazardly. The case picker may arrange the bottles in parallel rows crosswise and lengthwise, as in U.S. Pat. No. 3,546,838, in "nested" rows in which the containers in one row crosswise of the packer are parallel, but lengthwise of the packer each row is staggered with respect to the preceding and succeeding row so that the bottles in one cross row fit or nest into the generally V-shaped notches between the contacting bottles, as in U.S. Pat. No. 3,619,867. In either case the bottles move in rows crosswise of their direction of travel onto a receiving table with each row pushing the one ahead between side guides until the required number of rows to form a case lot is arranged on the receiving table.

When the required number of rows is on the receiving table, a gate means of some kind operates to prevent crowding of any more bottles onto the receiving table. The present invention in the instance here assumed is concerned with the lifting of this ordered arrangement of bottles as a unit from the receiving table and, when clear of said table, moving them over a carton and depositing them in the carton where they are snugly received in the same orderly arrangement.

Referring first to FIG. 5, A designates a case packer, as in either of my aforesaid patents, on which is an endless belt that receives the bottles haphazardly at the left end and, as they are carried along, they are arranged on the conveyor into cross rows before they are pushed off the right end of the belt over a dead plate onto a receiving table B until the leading row contacts a stop or limit C. When, in the example here assumed, six rows of ten bottles are on the receiving table, the first row to move onto the table will be crowded against a limit plate C and a stop bar D operated by an air cylinder will be lowered against the tops of the bottles of the next oncoming row as a gate means to limit the number of rows on the receiving table as soon as they are on the table and prevent excessive crowding of the case lot now on the table. Some such gate means is not per se new.

At this time a bottle lifting head E on an overhead track F will have been moved by a fluid pressure cylinder and piston G to a position exactly located above the receiving table B. The lifting head E will lower, and a separate pair of bottle engaging fingers as described in FIGS. 1 to 4 will be operated to simultaneously engage the bottles on the receiving table. The lifting head will then raise to lift the bottles clear of the receiving table. When so raised, cylinder G will be energized to move the lifting head to the right and position it over a carton H on a carton supporting structure I. The lifting head will be lowered with the containers hanging from it until the bottoms of the containers have entered the case load of containers when they will be released, the lifting head raised and returned to a position over the receiving table and the stop bar D will be raised and the cycle repeated with, of course, the removal of the loaded carton and its replacement by an empty one. It may be here mentioned that just before the lifting head raises to lift the case load of containers from the receiving table, the limit plate C may be rocked slightly to release the pressure against the group of bottles on the receiving table before they are lifted and thus avoid stressing any of the containers so that they would break or pull off the lifting fingers.

It is with the lifting bars and lifting head that this invention is principally concerned. This is more fully understood by reference to FIGS. 6 to 12, inclusive, which rather than being strictly in accordance with actual shop design and dimensional precision, are, in generaly, of a schematic nature.

Referring to FIGS. 6 and 7, the lifting head carrier has a frame structure 15 supported for movement by rollers 16 in parallel tracks 17 of channel section and extending, as shown in FIG. 5, from above the receiving table B to the right over the carton support I. A piston rod 18 (FIG. 5) connects the carriage with a fluid pressure operated piston in cylinder G.

The frame 15 has an air cylinder 19 (FIGS. 6 and 7) fixed thereon with a piston, the piston rod of which is indicated at 20. There is a cross bar 21 at the top of the piston rod to which suspension rods 22 are attached. These rods pass through the frame 17 in which they are freely slidable. They extend down and also pass slidably through a vertically movable platform 23. The lower ends of these rods have enlarged ends or abutments, such as threaded nuts **22*a* that normally bear against the underface of the platform 23. Compression springs 22*b* surround the rods 22 between frame 15 and the platform member 23 so that when fluid pressure is applied to the upper end of cylinder 19, through pipe 19*a*, the rods 22 will move down, allowing the head frame member 23 to lower by gravity but, should the head frame member and the parts which it carries encounter abnormal resistance, the springs 22*b* will yield to prevent the application of too great a pressure against the obstruction that the head frame and its dependent parts encounter. When the piston in cylinder 19 reaches its lower limit of travel, the admission of fluid pressure through the lower pipe 19*b* will lift the head frame member and its dependent parts to their elevated position by means of the upward travel of the rods 22**.

The head frame member 15, which is generally rectangular as viewed from above, has depending corner posts 24 on each of the four corners and the two posts at each end are connected by a cross strip 25. Each cross strip has a bayonet groove or inverted L-shaped groove 26 near each end. The platform 23 under the head frame member 15 that is also of rectangular shape and which has two pins 28 at each end, one of which is arranged to be entered into one each of the inverted L-shaped grooves in the cross strips 25. This enables the platform 23 to be placed in and removed from the head frame member. It also allows further limited upward travel of the platform if the parts below it and hereinafter described strike an obstruction as the head frame is lowered.

Below the platform there is the actual container or bottle lifting head itself, this being designated generally as 30. It comprises two spaced supporting rods 31, one along each side of the lifting head. The two rods 31 are joined at their ends by fixed cross bars 32, thus forming a rectangular frame. Each rod may also be secured by one or more readily removable fixed angle brackets 33 through the depending ends of which one of the rods passes and which have an upper extension bolted to the underside of platform 23.

As most clearly seen in FIG. 8, there are sleeve members 35 slidable on the rods 31, one near each end of each rod. The two sleeve members at each end of the rectangular frame are connected by a rigid cross member **35*a* so that the two sleeves slide on the rods 31** as a unit.

Referring to FIG. 6, two similar air operated cylinder and piston units are shown, which are reversed with respect to each other, one of them, designated 36, being at the left end of the platform 23 and the other, 37, being at the right end. When air under pressure is simultaneously admitted to the rear, that is, the confronting ends of the two cylinders, their respective pistons will move in opposite direction away from each other. When air under pressure is simultaneously admitted to the front ends of the two cylinders, the pistons will move toward each other. The piston rod of cylinder 36 passes through the upper end of a rigid arm 38 extending up from the center of the cross bar **35*a* connecting the sleeve members 35 at the left end of the platform 23 (see FIG. 11). This construction is duplicated at the right end of the platform but turned, of course, in the opposite direction, the rigid arm 38 at the right end extending up from the cross bar 35*b***.

As seen in FIGS. 6 and 11, there are two compression springs 40 around the piston rods of the cylinder-piston units 36 and 37, these springs on each piston bearing against opposite sides of the rigid extension 38 through which the piston rod passes and left and right abutments **40*a* fixed on the rod and equally spaced from the extension 38. With this arrangement motion of the piston rods is yieldably transmitted to the cross bars 35***a* and their respective sleeves 35.

Referring again to FIG. 8, it may be noted that each sliding sleeve member 35 has an enlarged end portion 35*b* at the end that is spaced inwardly toward the middle of the frame 30 from the cross bar 35*a*. The ends of a threaded cross rod 39 are secured to the enlargements 35*b* of the pair of sleeves at the left end of the platform and lifting head and there is a similar threaded cross rod extending between and joined to the sleeve enlargements at the other end of the platform and lifting head.

With this arrangement the admission of pressure air simultaneously to the inner ends of the cylinders of the units 36 will slide the sleeves and thereby move the threaded rods in opposite directions away from each other a short distance and then, by admitting air to the outer ends of the cylinders, the sleeves and cross rods will be moved toward each other a corresponding distance. Transmitting the motion from the piston rods to the sliding sleeves through springs 40 cushions the travel of the sleeves and the pressure which is exerted, as hereinafter appears, by the spreading or contraction of the pairs of fingers against the interior or exterior of the bottles.

Looking at FIGS. 8 and 9, there is shown a pair of strips 45 and 46 generally resembling the similar strips in FIGS. 1 and 2, in that one strip 45 has a notch 45*a* at its left end and strip 46 has a notch 46*a* at the opposite end, but in FIG. 8 the two strips are of the same length. Strip 45 has its lower corner at the end opposite the notch 45*a* cut away, as indicated at 45*b*. Strip 46 likewise has its end remote from the notch 46*a* similarly cut away at 46*b*. The strip 45 has its notch 45*a* hooked over the threaded rod 39 at one end of the platform 23 and its cut away opposite end portion 45 rests over the rod 39 at the other end of the platform while strip 46 is reversed, with its notch hooked over the second named rod 39 and its cut away end extending over the first of said rods 46. The side-by-side ends of the strips are confined on the respective rods between a pair of confronting threaded disks 47 screwed onto the respective rods but not tightly enough to prevent the contacting faces of the rods from sliding one against the other. Thus, when the slide assemblies are operated to move in opposite directions, strips 45 will be pulled to the right and strips 46 will be pulled to the left.

As shown in FIG. 8, several pairs of these strips or bars in equally spaced parallel relation and the threading of the pairs of disks 47 on the rods provide a micrometer adjustment for spacing the pairs of bars equally so as to center them exactly over the rows of bottles in a group to be lifted, with the plane of separation of the strips of each pair in or close to the diameter of the bottle openings in the rows of bottles to be lifted. As illustrative only, FIG. 6 shows each pair of bars made to provide ten pairs of fingers and six pairs of bars are indicated in FIG. 7, making the total of sixty simultaneously operable bottle gripping, lifting and transporting finger elements herein previously assumed as an example. With larger bottles there obviously would be fewer pairs of fingers on each pair of bars and the pairs of bars would be more widely separated, assuming the bottles to be arranged in the same pattern in each case, that is whether in rows or nested. In any case, bars for one size of bottle may be replaced with bars for another size of bottle where requirements of a user do not justify the purchase of a plurality of machines. Also, one lifting head may be readily replaced by another.

As explained earlier in this description, the bottles are pushed from the conveyor which arranges them in rows or in nested arrangement by the oncoming bottles. Usually they are pushed from the moving conveyor belt over a dead plate and onto the receiving table as is well known in the art. When the leading row of bottles contacts the limit plate C, the following bottles press against them and against one another. The stop bar D descends to bear against the tops of the last row of bottles on the dead plate, but this does not relieve the pressure under which the bottles were pushed onto the receiving table.

To relieve this pressure before the lifting head raises, the limit plate is moved slightly out of contact with the leading row of bottles on the receiving table. To this end, the limit plate C, as shown in FIG. 12, is pivoted to rock about a horizontal axis slightly below the level of the bottoms of the bottles on the receiving table. This is shown somewhat schematically in FIG. 12 where the limit plate C is supported to rock about a horizontal axis 50 extending lengthwise of the plate at or near its lower edge and preferably slightly below the level of the top surface of the receiving table B. The plate C has a rearwardly extending horizontal arm 51, providing a bell crank arrangement. Operating means, such as an air cylinder or magnet 52, is located under the outer end of this arm in such manner that downward movement of the arm tilts the plate C rearwardly a slight distance. This relieves the pressure of the bottles against the plate C and against one another and also against the oncoming row of bottles restrained at this time by the holding bar D. Air pressure or a spring 53, or both, may return the plate C to its upright position and hold it in such position after the group of bottles is lifted from the receiving table and before the next group is released upon raising of the bar D to move onto the receiving table.

The sequencing of the various operations may be effected manually by switches, push buttons, valves, etc. as will be readily understood by those skilled in the art, or may be automatically effected by valves and circuits forming no part, per se, of this invention and embodying well-known types of circuits as may be readily by technicians familiar with this and similar art.

We claim:

1. In an apparatus for lifting, transporting and depositing empty bottles and like hollow articles, the invention comprises:

(a) a pair of only two flat strips confined against each other in slidable face-to-face relation;

(b) supporting means on which the ends of the strips are engaged arranged to effect simultaneous sliding movement of both strips toward and away from a central position with the strips of the pair having their confronting faces in a vertical plane;

(c) the strips each having several depending equally spaced coplanar fingers thereon with one finger for each article in a row of articles to be lifted and transferred to another location, a finger on each strip forming with a cooperating finger on the other strip a pair of such fingers, the fingers of each pair being movable with their respective strips in parallel planes in such manner that, with small bottles, the fingers of each pair may be moved into and out of overlapping relation with the movement of their respective strips;

(d) each finger of each pair having a lug projecting therefrom in the direction of the plane of movement of the strip on which it is carried so that they move toward and away from each other with the relative sliding movement of the strips;

(e) the combined thickness of the strips in a plane transverse to the length of the strips being less than the width of the fingers in the plane of sliding movement of the strips.

2. The apparatus defined in claim 1 in which said fingers have a width in the plane of their respective strips greater than the thickness of the strip whereby their resistance to bending in the plane of relative travel of the strips is greater than in a direction transverse to said plane.

3. The apparatus defined in claim 1 in which the fingers of the pair overlap in such manner that the combined width of the fingers in a single pair is less than the diameter of the neck opening of a bottle or like object to be engaged but wherein the relative movement of the strips in one direction expands the overall width of the fingers with their lugs sufficiently to prevent withdrawal of the finger from the bottle or like object when so expanded and until they are again restored to the overlapped relation.

4. The apparatus defined in claim 1 in which the fingers of the pair may be separated for a distance in the direction of the lengths of the strips greater than the outside diameter of the neck of the bottle or the like to be picked up but wherein the relative movement of the strips in one direction from a location of maximum separation of the fingers of the pair toward each other brings their respective lugs into clamping relation with the neck of a bottle or the like centered between the fingers.

5. The apparatus defined in claim 1 in which there are a plurality of pairs of strips equally spaced from one another with the strips of each pair having a multiple of pairs of fingers depending therefrom for simultaneously lifting, moving and releasing a plurality of bottles or the like while keeping them arranged in a preselected pattern.

6. The apparatus defined in claim 5 wherein the support comprises a vertically movable lifting head with the several pairs of strips so positioned that their respective pairs of fingers are so positioned that each pair of fingers engages one bottle in a plurality of bottles arranged in parallel rows in a predetermined pattern, and wherein there is a means for lowering the lifting head from an elevation where the depending pairs of fingers are clear of such arrangement of bottles to a level where the pairs of fingers may be operated to engage the neck portions of the respective bottles and for raising the lifting head when the fingers have been so engaged with the bottles, and wherein the lifting head includes means for simultaneously effecting said opposite endwise movement of the strips of all of such pair of strips.

7. The apparatus defined in claim 6 in which said means for lowering and raising the lifting head includes a resilient connection arranged to yield if the lowering movement of the head is obstructed to avoid crushing of any of the bottles in the several rows of bottles resulting from any irregularity of the placement of any bottles in the prearranged pattern.

8. The apparatus defined in claim 6 wherein said last named means includes resilient means through which motion is transmitted to the pairs of bars to yield and cushion the opposite motions of the bars of each pair to avoid breakage of bottles should unexpected resistance to the movement of any strip in any pair be encountered.

9. The apparatus defined in claim 6 in which the lifting head comprises a rigid frame suspended from a supporting platform, said frame having a horizontally movable slide assembly at each end, each slide assembly including a cross rod, one strip of each pair of strips having a hook at one end engaged over a cross bar of one slide assembly and the other strip of each pair having its opposite end having a hook engaged over the rod of the other slide assembly, whereby simultaneous movement of the of the slide assemblies toward and away from each other will move the strips of each pair relative to each other in the direction of the movement of the cross rod to which the hook of the strip is engaged, and pneumatic means on said platform connected with the respective slide assemblies arranged to simultaneously effect opposite movement of the slide assemblies toward and away from each other and toward each other through a predetermined limited distance.

10. The apparatus defined in claim 6 wherein the lifting head is suspended from a carriage supported for movement horizontally between a bottle lifting position and a bottle lowering and releasing position, and means for effecting such horizontal travel of the carriage between said two positions.

11. The apparatus defined in claim 10 wherein the bottle lifting position is over the receiving table of a case packer arranged to deliver a predetermined number of rows of bottles onto the receiving table in a prearranged pattern, wherein the receiving table has a limit plate against which the bottles are pressed as the predetermined number of rows of bottles are moved onto the receiving table, and means operable to move the limit plate away from the bottles pressing against them and thereby relieve the pressure holding the bottles in the prearranged pattern on the table before the lifting head is operated to lift the bottles clear of the lifting table.

12. The invention defined in claim 1 wherein the supporting means is provided with means for adjustably positioning and holding said pair of strips transversely of their length to substantially center the plane of separation between the strips over a row of aligned bottles positioned under the supporting means.

13. The invention defined in claim 1 in which the supporting means carries an operating means for simultaneously but yieldably moving the strips in opposite direction from a central position and to return them to the central position and arranged whereby the relative movement of the strips may stop when the fingers encounter a predetermined resistance to further movement.

* * * * *